United States Patent [19]

Westergard et al.

[11] Patent Number: 4,858,553

[45] Date of Patent: Aug. 22, 1989

[54] SHORT-DWELL COATER

[75] Inventors: Sivert Westergard; Pekka Koivukunnas, both of Järvenpää, Finland

[73] Assignee: Valmet Paper Machinery Inc., Helsinki, Finland

[21] Appl. No.: 77,250

[22] Filed: Jul. 24, 1987

[30] Foreign Application Priority Data

Jul. 25, 1986 [FI] Finland ..... 863048

[51] Int. Cl.[4] ..... B05C 11/04

[52] U.S. Cl. ..... 118/126; 118/410

[58] Field of Search ..... 118/126, 410

[56] References Cited

U.S. PATENT DOCUMENTS

| | | | |
|---|---|---|---|
| 2,761,418 | 9/1956 | Russell | 118/410 |
| 3,070,461 | 12/1962 | Beachler | 118/126 X |
| 3,518,964 | 7/1970 | Nagler | 118/410 X |
| 4,405,661 | 9/1983 | Alheid | 118/410 X |

*Primary Examiner*—Shrive Beck
*Assistant Examiner*—Alain Bashore
*Attorney, Agent, or Firm*—Birch, Stewart, Kolasch & Birch

[57] ABSTRACT

A short-dwell coater comprises of a backing roll (1) used for guiding a paper web (1), with an upper lip (28) and a lower lip (28) forming a nozzle apparatus. This nozzle apparatus can apply the coating mix on the paper web while the web is backed by the surface of the backing roll. A doctoring member with which the excess mix applied with the nozzle apparatus can be doctored is also provided as well as a mounting fixture, to which the doctoring member is mounted, and a support structure, with which the fixture is supported. In the short-dwell further comprises an actuator, to which the nozzle apparatus is attached so that the apparatus is movable in relation to the doctoring member in order to adjust the dwell length between the doctoring member and the nozzle apparatus.

5 Claims, 4 Drawing Sheets

SHORT-DWELL COATER

The present invention relates to a short-dwell coater.

A coater is used for single-sided coating or sizing of a paper web at different web speeds. The preferred method for use of the coater is at high speeds when a smooth coating is ultimately desired. Another preferred application is in the coating a board at low speeds, in which method a bent blade is used.

DESCRIPTION OF THE BACKGROUND ART

The short-dwell coaters of conventional technology are based on a constant dwell length.

The conventional short-dwell coaters have the problem that sufficiently high coat weights cannot be applied in a controllable manner on the web. With the extremely short dwell length in the short-dwell coater, higher coat weights are aimed at by utilizing overpressure at the application zone. Conversely this causes problems with the end seals and the smoothness of the coat.

SUMMARY OF THE INVENTION

The aim of this invention is to overcome the disadvantages associated with the prior art technology and to achieve a totally new kind of a short-dwell coater.

The invention is based on optimizing the dwell length to be as short as possible with the help of a moveable nozzle apparatus, while retaining the means for applying a sufficiently thick coat on the web.

More specifically, the short-dwell coater in accordance with the invention is primarily characterized by a backing roll, a nozzle apparatus, a doctoring member, a mounting fixture, a supporting structure, and an actuator means.

The invention provides outstanding benefits.

Due to the optimized dwell length, a low moisture content of the paper web is achieved, which improves the coat quality and runnability of the paper machine. The coating mix is applied in sufficient weight onto the base stock in smoother coats than before while the machine can additionally be run using both a straight and a bent blade. Furthermore, the end seals are no longer absolutely mandatory.

Further scope of applicbility of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
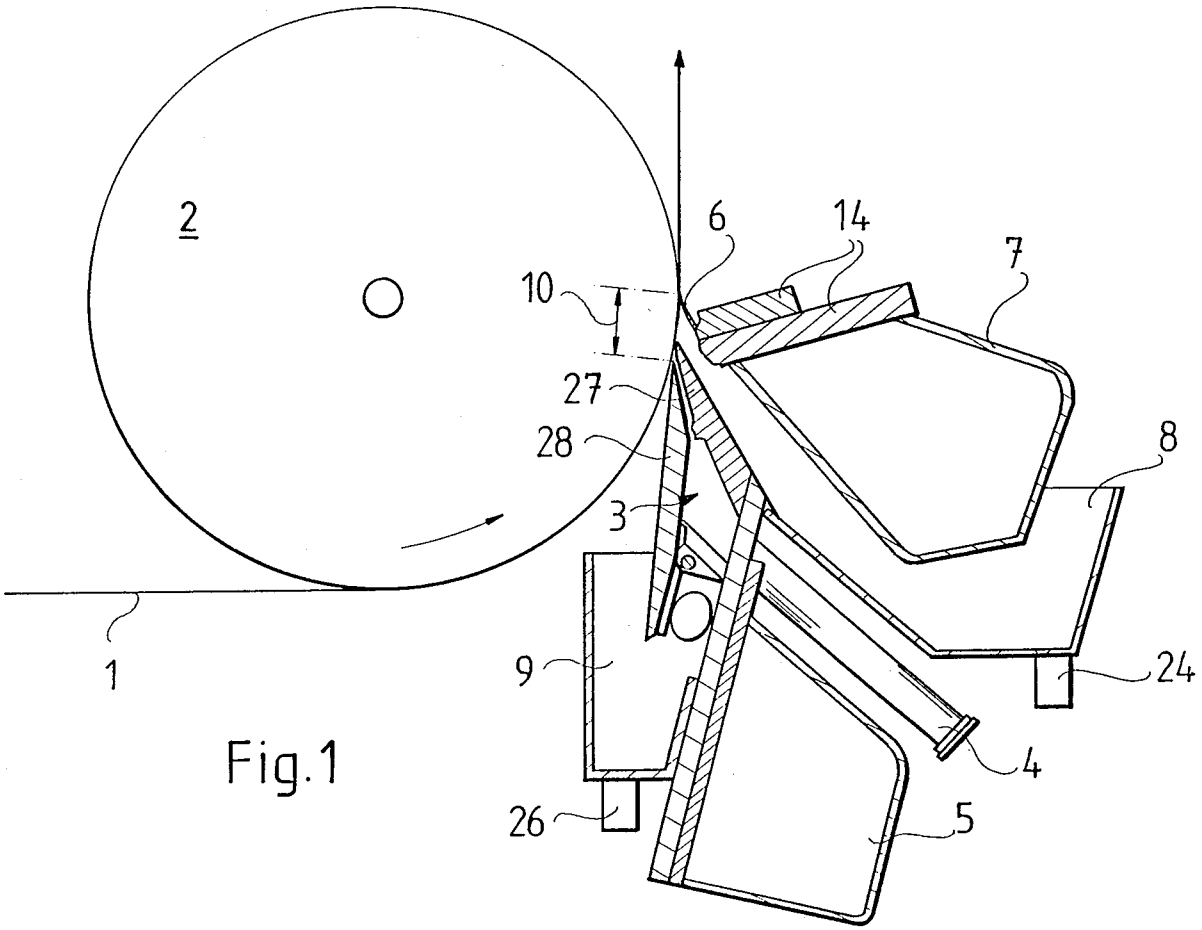
FIG. 1 shows a partly cross-sectional side view of a short-dwell coater in accordance with the present invention.

The cross-sectional view illustrated in FIG. 1 shows the main components of the apparatus of the present invention. A paper web 1 is adapted to run upwardly in the coater unit. A backing roll 2 rotates at an angular velocity corresponding to the speed of the web 1. A feeder pipe 4 conveys the coating mix to a nozzle apparatus 3, consisting of an upper lip 27 and a lower lip 28, which finally applies the mix onto the web 1. With the help of a doctoring blade 6, fitted with a blade mounting fixture 14 to a first steel beam 7 operating as a support structure, the excess mix is doctored away and flows to a first tray 8, from where it can be recirculated via an outlet pipe 24 to be retreated and reused.

Figure 2:
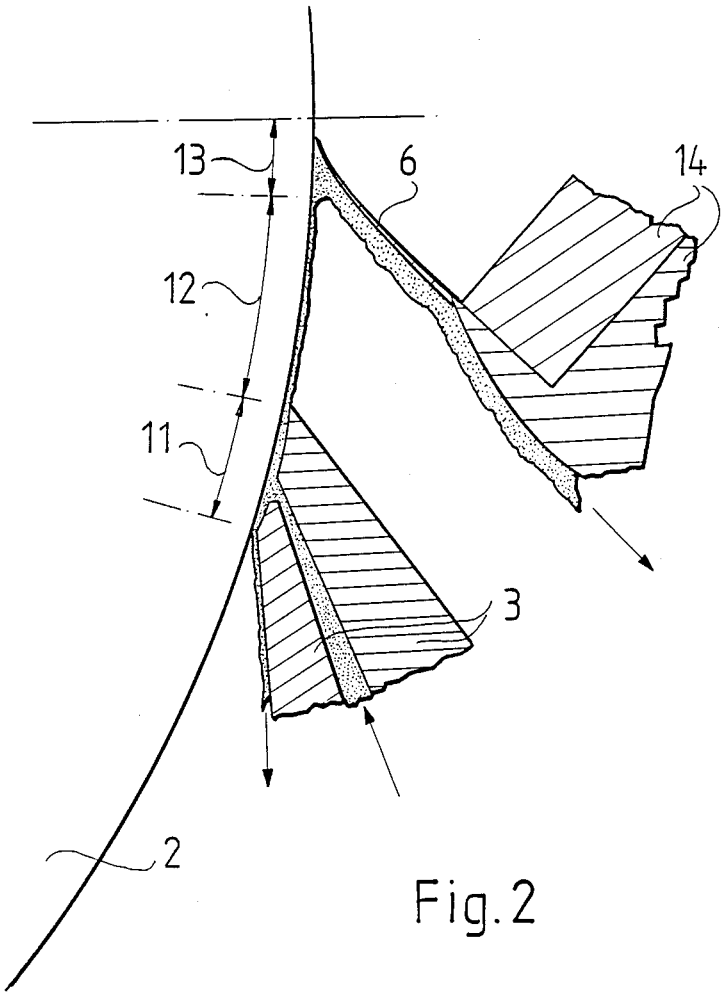
FIG. 2 shows a partly cross-sectional side view of a detail around the point of coat application in the short-dwell coater illustrated in FIG. 1.

The support structure of the nozzle apparatus 3 is another steel beam 5. Instead of the doctoring blade 6, a doctoring bar can also be used. The coat is returned via the nip between the nozzle apparatus 3 and the web to the tray 9 for recirculation. A portion of the coat is already returned prior to the nozzle apparatus 3 to another tray 9, from where the excess mix flows via an outlet pipe 26 for retreatment. The nozzle apparatus 3 together with its trays 8, 9 are moveable by means of the blade/beam assembly 6, 7 in order to adjust a dwell length 12. An application length 10, shown in FIG. 1, is further detailed in FIG. 2 into a doctoring length 13, a dwell length 12 and a nozzle length 11.

Figure 3:
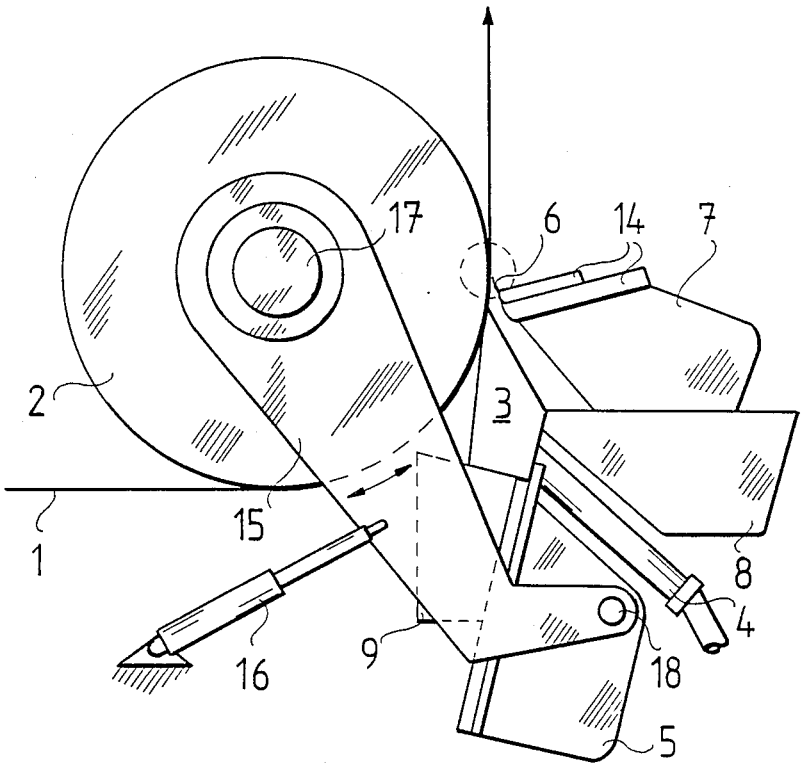
FIG. 3 shows a side view of an apparatus illustrated in FIG. 1, and specifically, an actuator mechanism, in which the control of dwell length is implemented by supporting the nozzle apparatus with rotatable arms.

FIG. 3 shows a possible method for implementing the adjustment of the dwell length 12. The nozzle apparatus 3 together with its trays 8, 9 is rotatably mounted with a backing roll support lever 15 to a shaft 17 of a backing roll 2. The backing roll support lever is moveable, for instance, by a hydraulic cylinder 16 so that a bearing 18 of the nozzle apparatus 3 at the other end of the backing roll support lever 15, together with the other components, is moved around the perimeter of a circle, whose center point is the rotation center point of the backing roll 2. In the apparatus in accordance with the figure, the outward movement of the hydraulic cylinder 16 shortens the dwell length 12. With this arrangement, the nozzle apparatus 3 meets the paper web 1 always at a constant angle, irrespective of the set dwell length 12, and furthermore, the nip of the nozzle apparatus 3 with the paper web 1 remains constant.

Figure 4:
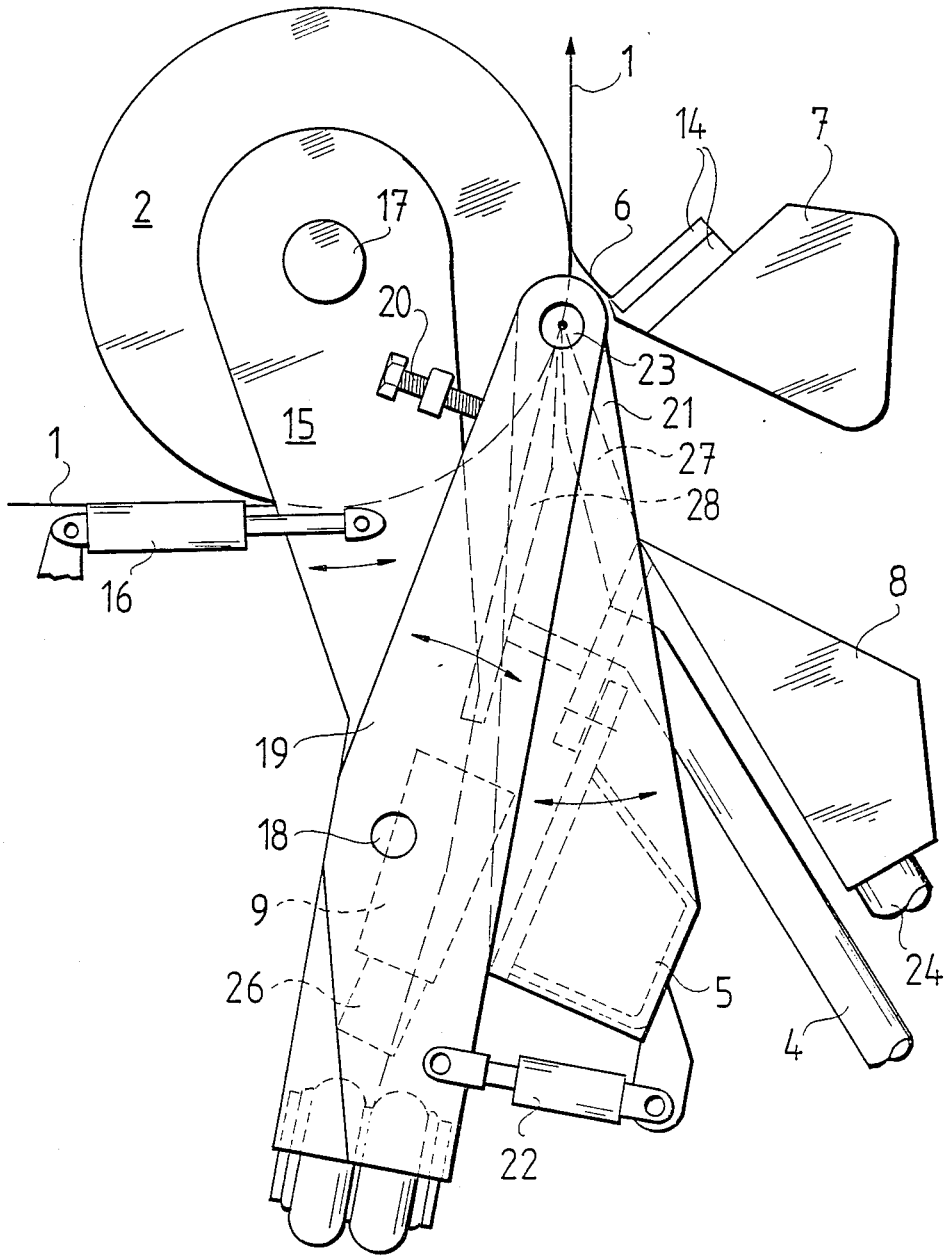
FIG. 4 shows a side view of another apparatus in accordance with the invention having an adjustable angle and nip in respect to the web.

FIG. 4 shows a possible method for implementing the nip adjustment of the upper lip 27 and the lower lip 28 with the web 1 in the apparatus according to the invention. An upper lip lever 19 is rotatably mounted to the backing roll support lever 15 via a bearing 18. The bearing 18 of the upper lip lever 19 is located at the opposite end of the backing roll support lever 15, relative to the bearing point of a shaft 17 of the backing roll 2. With the help of an adjustment screw 20, the upper lip lever 19 is rotatably moveable about the bearing 18, thus providing a nip adjustment between the web 1 and the upper lip 27 adapted to the upper lip lever 19. Furthermore, a lower lip lever 21 is rotatably mounted to the upper lip lever 19 with the help of a bearing 23. The bearing 23 of the lower lip lever 21 is located at the opposite end of the upper lip lever 19, relative to the bearing 18 of the upper lip lever 19. The lower lip lever 21 is moveable about its bearing point 23 by means of a hydraulic cylinder 22 connecting the lower ends of the lower lip lever 21 and the upper lip lever 19 in order to adjust the distance of the lower lip 28 from the web 1. The adjustments always provide an optimal position for the nozzle apparatus 3 corresponding to a set dwell length 12.

The movement of the nozzle apparatus 3 can also be implemented pneumatically, or directly with the help of an electric motor. If the attachment point of the nozzle apparatus 3 is different from the rotation axis 17 of the backing roll 2, the position of the nozzle must be altered when the dwell length 12 is adjusted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A short-dwell coater comprising:

a backing roll for guiding paper web, said backing roll having a shaft;

a nozzle apparatus consisting of an upper lip and a lower lip, with which the coating mix can be applied to the web backed by the surface of the backing roll;

a member for doctoring excess mix applied with the nozzle apparatus;

a mounting fixture to which the doctoring member is attached;

a supporting structure by which the mounting fixture is supported; and actuator means to which the nozzle apparatus is fitted for moving said nozzle apparatus in relation to the doctoring member, said actuator means comprising a backing roll support lever for pivotably mounting said nozzle apparatus to the shaft of the backing roll and comprising an actuator member for pivotably moving the nozzle apparatus relative to the backing roll and to the doctoring member for adjusting dwell length between the doctoring member and the nozzle apparatus.

2. The short-dwell coater in accordance with claim 1, characterized in that the actuator member (16) is a hydraulic cylinder.

3. The short-dwell coater in accordance with claim 1, characterized in that the nip between the web (1) and the upper lip (27) of the nozzle apparatus (3) attached to the actuator means (15, 16) is adjustable by a first control member (20), and the distance of the lower lip (28) from the web is adjustable by a second control member (22) in order to optimize the coating result.

4. The short-dwell coater in accordance with claim 3, characterized in that the lower lip assembly (21, 28) of the nozzle apparatus (3) is mounted pivotally to the backing roll support lever (15), and the upper lip assembly (19, 27) is mounted pivotally to the lower lip assembly (21, 28) for control purposes.

5. The short-dwell coater in accordance with claim 4, characterized in that the first actuator member (20) is an adjustable screw and the second control member (22) is a hydraulic cylinder.

* * * * *